United States Patent [19]

Jöns

[11] 4,017,224

[45] Apr. 12, 1977

[54] GEAR MACHINE WITH CUTOUTS IN THE SHAFT JOURNALS

[75] Inventor: Claus Jöns, Munchingen, Germany

[73] Assignee: Robert Bosch G.m.b.H., Stuttgart, Germany

[22] Filed: Feb. 25, 1976

[21] Appl. No.: 661,162

[30] Foreign Application Priority Data

Mar. 11, 1975 Germany ..... 2510496

[52] U.S. Cl. ..... 418/131; 418/189

[51] Int. Cl.[2] ..... F01C 19/08; F03C 3/00; F04C 27/00

[58] Field of Search ..... 418/131, 132, 135, 189, 418/190

[56] References Cited

UNITED STATES PATENTS

| | | | |
|---|---|---|---|
| 2,714,856 | 8/1955 | Kane | 418/132 |
| 2,884,864 | 5/1959 | Bobnar | 418/189 |
| 3,003,426 | 10/1961 | Lauck | 418/135 |
| 3,051,091 | 8/1962 | Bennett et al. | 418/132 |
| 3,113,524 | 12/1963 | Fulton | 418/189 |

*Primary Examiner*—John J. Vrablik
*Attorney, Agent, or Firm*—Michael J. Striker

[57] ABSTRACT

A hydraulic gear-type machine has two meshing gears with axis-defining shafts received in respective journals having end faces turned axially toward the respective gears and formed with cutouts opening in opposite directions in line with input and output passages formed in a housing carrying the journals and enclosing the gears. The journals abut flatly at the cutouts along surfaces extending axially to immediately adjacent gears and chordally to cylindrical continuations of the outer surfaces of the journals. Each of the journals on each axial side of each gear is therefore formed with a recess opening toward the inlet passage and with a recess opening toward the outlet passage.

7 Claims, 3 Drawing Figures

GEAR MACHINE WITH CUTOUTS IN THE SHAFT JOURNALS

BACKGROUND OF THE INVENTION

The present invention relates to a hydraulic machine. More particularly, this invention concerns a gear-type hydraulic pump or motor.

A hydraulic machine is known wherein two meshing gears have parallel axis-defining shafts received in respective journals in turn having end faces turned axially toward the respective gears. These journals are formed at their end faces with cutouts opening in opposite directions in line with input and output passages formed in a housing carrying the journals and enclosing the gears.

Usually in such a machine the journals are basically cylindrical, and each abuts the other at a plane that extends parallel to the respective journal axis. In this manner rotation of the journals about their axes is prevented. In such an arrangement one or both of the gears can be driven in order to operate the device as a pump, or pressurized fluid can be forced through it to use it as a hydraulic motor.

The cutouts formed at the axial ends of the journals facing the gears are usually each constituted in half by one of the journals and have outwardly open generally rectangular shape. These cutouts ensure proper flow of fluid into the spaces between the gear teeth and maximize efficiency in operation of the pump or motor. A disadvantage of such a formation is that it decreases the size of the abutting and, hence, sealing surfaces of the adjacent bearings so that leakage between the journals becomes possible. Furthermore, the fluid is channeled by such formations to the teeth in such a manner as often to cause premature wear of these teeth and leakage through the pump or motor. The two journals form a relatively thin wall between the inlet or low-pressure side of the device and outlet or high-pressure side.

SUMMARY OF THE INVENTION

It is therefore an object of the present invention to provide an improved gear-type fluid machine.

Yet another object is to provide such a machine which overcomes the above-given disadvantages.

These objects are attained according to the present invention in a hydraulic machine of the abovedescribed type wherein the journals abut flatly at their cutouts along surfaces which extend axially to immediately adjacent gears and transversely chordally to cylindrical continuations of the outer surfaces of the journals. Each of the journals in addition is formed on each axial side of each gear with a recess opening toward the inlet passage and with a recess opening in the opposite direction toward the outlet passage.

With this arrangement journals therefore abut along relatively large surfaces so that the possibility of leakage between them is minimized. Furthermore, the cutout on each side is actually formed as two recesses flanking the plane along which the journals abut and facing in the same direction on each side of the center of the device. In this manner the surfaces over which the teeth ride on these journals are of maximum possible dimensions so that an eating-in of the teeth into the journals is largely avoided.

Thus, in accordance with the present invention each journal is of generally cylindrical shape but has one side defined by an axially extending surface so as to give the overall journal a D-section. In addition each journal is formed at one end, that is the end to faces the respective gear, with a pair of recesses extending generally parallel to the flat edge of the journal and toward one another but opening in opposite directions.

In accordance with the present invention the recesses on the journals which each form half of a respective cutout are of decreasing width toward their bases. The two recesses forming each cutout flank a symmetry plane lying on the flat abutting surfaces of the journals. In addition the bases of the two recesses forming each cutout lie on a plane extending parallel to the axes of the gears and spaced from the corresponding plane of the opposite cutout by a distance which is a minor fraction of the length of the abutting journal surfaces measured in a direction perpendicular to the axes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
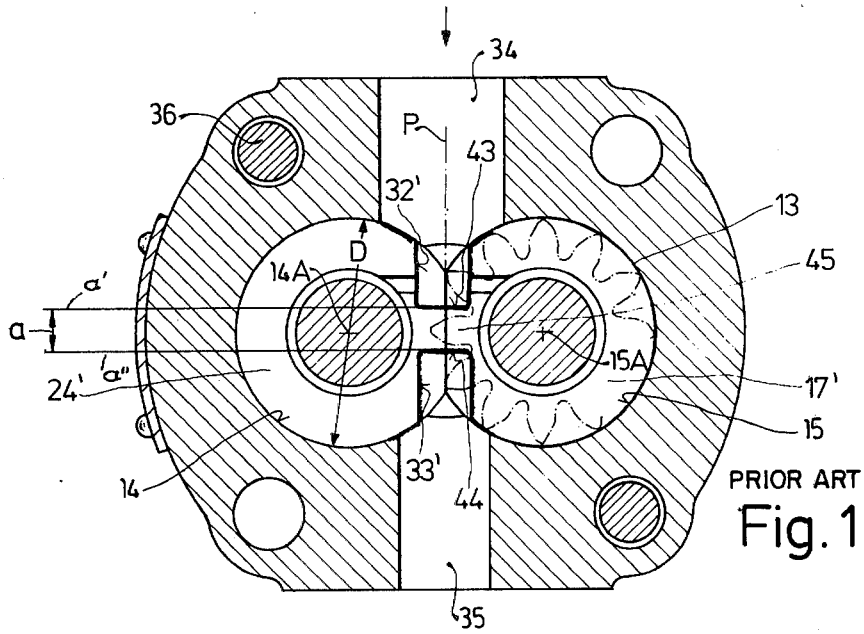
PRIOR ART Fig. 1
FIG. 1 is a sectional view through a prior-art pump.
Figure 2:
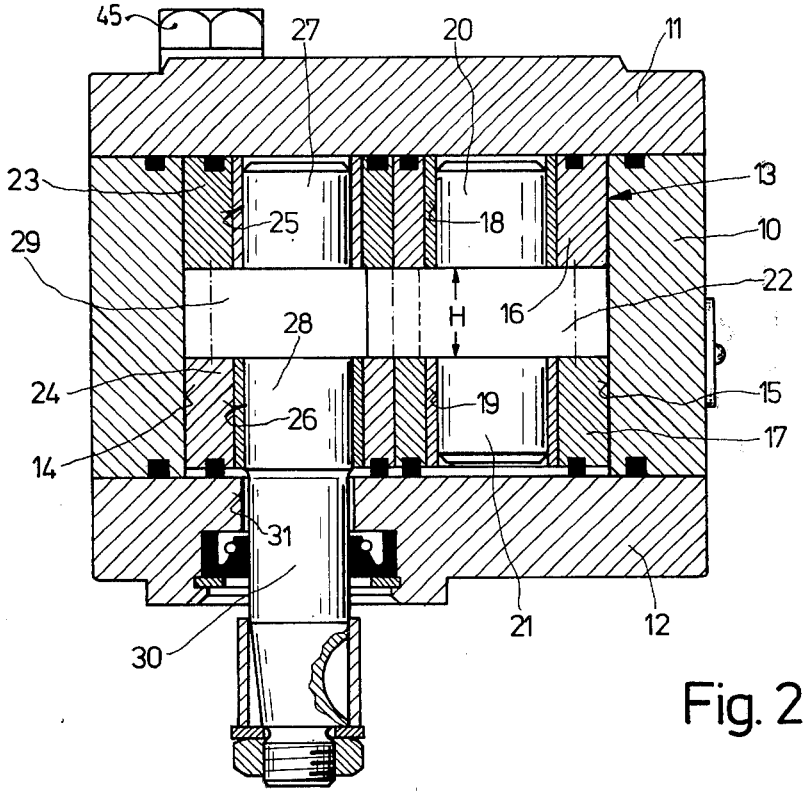
FIG. 2 is an axial section through a pump or hydraulic motor in accordance with the present invention.

A hydraulic machine as shown in FIGS. 1 and 2 has a central housing part 10 to whose ends are secured plates 11 and 12 by means of bolts 46. The housing 10 forms a chamber 13 itself defined by a pair of parallel bores 14 and 15 which are centered on axes 14A and 15A and meet at a plane P that therefore serves as a symmetry plane for the housing 10 and the chamber 13.

The bore 15 is provided with axially aligned and spaced apart journals 16 and 17 having respective borings 18 and 19 in which fit shaft ends 20 and 21 of a gear wheel 22. Similarly, the bore 14 is provided with a pair of sleeve journals 23 and 24 having axially centered and aligned bores 25 and 26 receiving respective shaft ends 27 and 28 of a gear wheel 29 that meshes with the gear 22. In addition, the shaft end 28 has an extension 30 which passes through a hole 31 in housing cover plate 12 and is adapted to be driven by a motor for use of the device as a pump or is adapted to carry a pulley or the like when the device is used as a motor and power is to be taken off at this shaft 30.

The two gears 22 and 29 are of the same axial height H and the housing 10 is formed at one side only in the region of these gears 22 and 29 with an inlet passage 34 and on its opposite side with an outlet passage 35. The plane P bisects both of the passages 34 and 35 and the inlet passage 34 is of greater flow cross-section than the passage 35. Both of these passages 34 and 35 are of uniform axial height equal to the distance H.

In the prior-art system shown in FIG. 1, the journals 17 and 24, which are identical to the journals 16 and 23, are shown to have end surfaces 17' and 24' forming cutouts 32' and 33' opening in the direction of inlet passage 34 and outlet passage 35, respectively. These cutouts 32′ and 33′ are generally rectangular and are bisected by the plane P. Their base surfaces 43 and 44 lie on parallel lines a′ and a″ separated by a distance a equal to between 1–4 and 1–6, here 1–5th, of the diameter D of the bore 14.

Figure 3:
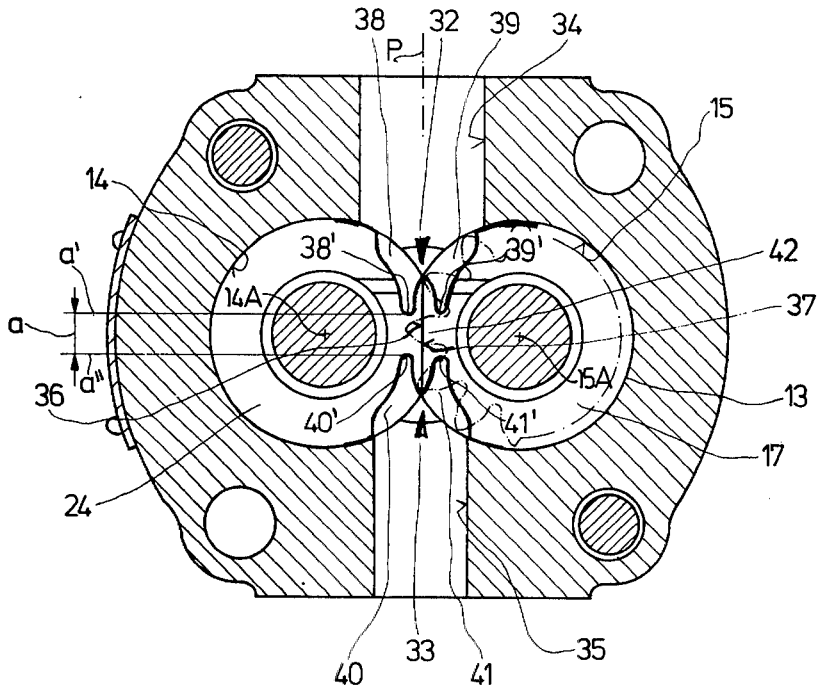
FIG. 3 is a section similar to FIG. 1 showing a machine in accordance with this invention.

With the arrangement in accordance with the present invention as shown in FIGS. 2 and 3, the bearings or journals 17 and 24 form two-part cutouts 32 and 33. The cutout 32 is constituted by a pair of recesses 38 and 39 flanking the plane P and open toward the inlet hole 34. The cutout 33 is formed by a pair of identical such recesses 40 and 41 opening into the outlet conduit 35. The bearings 17 and 24 therefore abut along planar faces 36 and 37 which lie on the plane P′ and which as is clearly visible in FIG. 3 extend all the way to the cylindrical continuation of the outer surfaces of these journals 17 and 24.

Thus with the system according to the present invention, although the bases 38′–41′ of the recesses 38–41 lie on planes a′ and a″ spaced apart at a distance a the two surfaces 36 and 37 abut over a distance equal to approximately 3*a*. These cutouts 38–41 are less than 10 mm deep and have a depth equal to a fraction of the height H.

The cutouts 38–41 serve to feed the hydraulic fluid or oil axially to the teeth in the region of mesh and to allow the fluid to be squeezed from between the teeth in this region. Since the journals abut on surfaces 36 and 37 that are considerably greater than has hitherto been known, the amount of wear that these elements will be subjected to in this region is reduced as the axial pressure is spread out over a larger area.

It will be understood that each of the elements described above, or two or more together, may also find a useful application in other types of machines differing from the types described above.

While the invention has been illustrated and described as embodied in a hydraulic type pump or motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a hydraulic machine wherein two meshing gears have parallel axis-defining shafts received in respective journals having end faces turned axially toward the respective gears and formed with cutouts opening in opposite directions in line with input and output passages formed in a housing carrying said journals and enclosing said gears, the improvement wherein said journals abut flatly at said cutouts along surfaces extending axially to immediately adjacent said gears and chordally to cylindrical continuations of the outer surfaces of said journals, each of said journals on each axial side of each gear being formed with a recess opening toward said inlet passage and a recess opening toward said outlet passage, each recess with the adjacent recess opening in the same direction constituting a one of said cutouts.

2. The improvement defined in claim 1 wherein said recesses have an axial depth equal to a minor fraction of the axial length of the respective gear.

3. The improvement defined in claim 1 wherein said recesses have bases and taper in the direction of said surfaces toward said bases.

4. The improvement defined in claim 1 wherein said gears have teeth and each of said recesses has a base spaced from the base of the other opposite recess of the same journal by a distance greater than the width of a one of said teeth.

5. The improvement defined in claim 4 wherein said surfaces have a length in a direction perpendicular to the axes of said shafts equal to at least twice said distance.

6. The improvement defined in claim 4 wherein said journals are symmetrical to each other about a symmetry plane lying on said surfaces, said recesses of each cutout symmetrically flanking said plane.

7. The improvement defined in claim 6 wherein said journals are mainly of D-section.

* * * * *